US006089654A

United States Patent [19]

Burstein

[11] Patent Number: 6,089,654

[45] Date of Patent: Jul. 18, 2000

[54] MODULAR FURNITURE FOR CHILDREN

[76] Inventor: Sharon A. Burstein, 10 Thurlow Ter., Albany, N.Y. 12203

[21] Appl. No.: 08/260,674

[22] Filed: Jun. 16, 1994

Related U.S. Application Data

[63] Continuation of application No. 08/004,990, Jan. 15, 1993, abandoned.

[51] Int. Cl.[7] ..... A47B 39/00; A47D 1/00

[52] U.S. Cl. ..... 297/151; 297/284.4; 297/153; 297/130; 297/133; 297/119; 297/134; 297/484; 297/440.23; 297/440.14; 297/327

[58] Field of Search ..... 297/149, 153, 297/130, 133, 118, 119, 134, 484, 440.23, 440.24, 440.14, 326, 327, 284.4, 284.5, 284.6, 286.7, 284.8, 151

[56] References Cited

U.S. PATENT DOCUMENTS

| | | | |
|---|---|---|---|
| D. 139,241 | 10/1944 | Wright | D15/8 |
| D. 153,333 | 4/1949 | Arnao | D15/8 |
| D. 237,023 | 10/1975 | Rossi, III | D6/8 |
| D. 291,156 | 8/1987 | Nakao et al. | D6/338 |
| 325,178 | 8/1885 | Knowlton . | |
| D. 327,180 | 6/1992 | Fonville | D6/399 |
| 329,479 | 11/1885 | Ordway | 297/327 |
| 451,058 | 4/1891 | Koeser . | |
| 875,903 | 1/1908 | Flemming | 297/133 |
| 1,060,503 | 4/1913 | Schmucker . | |
| 1,259,604 | 3/1918 | Cook . | |
| 1,505,518 | 8/1924 | Workman | 297/149 |
| 1,724,569 | 8/1929 | Elliott | 297/151 |
| 1,922,418 | 8/1933 | Conant | 297/345 X |
| 2,060,298 | 11/1936 | Gailey | 297/284.5 X |
| 2,529,687 | 11/1950 | Greenbaum | 297/149 X |
| 3,233,942 | 2/1966 | Creutz | 297/118 |
| 3,279,489 | 10/1966 | Radke | 297/284.7 X |
| 3,288,525 | 11/1966 | Cerf | 297/284.8 |
| 3,330,897 | 7/1967 | Lay et al. | 297/148 |
| 3,632,162 | 1/1972 | Trethaway | 297/149 |
| 4,097,087 | 6/1978 | Garavaglia | 297/284.7 |
| 4,402,548 | 9/1983 | Mason | 297/484 X |
| 4,632,454 | 12/1986 | Naert | 297/284.4 |
| 4,634,176 | 1/1987 | Scott | 297/284.7 |

(List continued on next page.)

FOREIGN PATENT DOCUMENTS

| | | | |
|---|---|---|---|
| 163460 | 11/1948 | Austria | 297/130 |
| 179968 | 4/1952 | Austria | 297/119 |
| 775067 | 10/1934 | France | 297/327 |
| 1110442 | 10/1955 | France | 297/133 |
| 1225390 | 2/1960 | France | 297/133 |
| 2320072 | 3/1977 | France | 297/130 |
| 3634500 | 8/1987 | Germany | 297/284.4 |
| 15379 | of 1894 | United Kingdom | 297/345 |
| 28395 | of 1911 | United Kingdom | 297/484 |
| 762304 | 11/1956 | United Kingdom | 297/284.7 |
| 1011726 | 12/1965 | United Kingdom | 297/284 |
| 1299789 | 12/1972 | United Kingdom | 297/284.6 |

OTHER PUBLICATIONS

1993/1994 *Service Merchandise* Catalogue, p. 546, No.1, Gerry® Two–In–One High Chair.

*Primary Examiner*—Peter M. Cuomo
*Assistant Examiner*—David E Allred
*Attorney, Agent, or Firm*—Morgan & Finnegan, LLP

[57] ABSTRACT

A modular item of child's furniture can be converted from a high chair to a child's chair by removing four chair leg extensions. A lumbar support is provided for the child occupying the chair that is shaped to match the average physiological needs of an infant from birth to two years of age. An adjustable safety strap that is drawn over the child's shoulders restrains dangerous side-to-side swaying motion. A tray also is provided that can be installed on the chair or removed from the chair through a single adult hand manipulation as well as being assembled into a table by attaching the chair leg extensions to the tray.

An arcuate rung also can be attached to the chair legs in order to convert the chair into a rocking chair.

10 Claims, 6 Drawing Sheets

U.S. PATENT DOCUMENTS

| | | | |
|---|---|---|---|
| 4,718,724 | 1/1988 | Quinton | 297/284.7 |
| 4,795,209 | 1/1989 | Quinlan et al. | 292/153 |
| 4,807,928 | 2/1989 | Cone | 297/153 |
| 4,810,034 | 3/1989 | Beier | 297/284.7 |
| 4,824,169 | 4/1989 | Jarrell | 297/284.5 X |
| 4,854,638 | 8/1989 | Marcus et al. | 297/250 |
| 4,936,628 | 6/1990 | Delaney et al. | 297/153 X |
| 4,938,603 | 7/1990 | Turner et al. | 297/153 X |
| 4,968,092 | 11/1990 | Giambrone | 297/153 X |
| 5,039,169 | 8/1991 | Bougher et al. | 297/484 |
| 5,123,699 | 6/1992 | Warburton | 297/219 |
| 5,135,285 | 8/1992 | Dukatz et al. | 297/484 |
| 5,158,337 | 10/1992 | Legett | 297/250.1 |
| 5,211,446 | 5/1993 | Jay | 297/284.7 |
| 5,425,567 | 6/1995 | Albecker, III | 297/377 |
| 5,460,427 | 10/1995 | Serber | 297/284.7 X |
| 5,474,362 | 12/1995 | Albecker, III | 297/284.4 X |
| 5,567,011 | 10/1996 | Sessini | 297/284.7 |

MODULAR FURNITURE FOR CHILDREN

This is a continuation of application Ser. No. 08/004,990, filed on Jan.15, 1993 now abandoned.

TECHNICAL FIELD

This invention relates to furniture and, more specifically, to orthopedically correct modular furniture for infants and small children that selectively provides a high chair, a rocking chair, and the like.

BACKGROUND ART

For many years high chairs have been used to introduce a degree of comfort in feeding infants and small children. This item of children's furniture is characterized by a small, child-sized chair that is mounted on long legs to bring the level of a child, sitting in the chair, up to the level of a seated adult in order to enable the adult to feed the child with comfort to both. A horizontally disposed tray is mounted, usually above the seat portion of the high chair, to extend across the child's lap. Food, eating utensils, and the like, ordinarily are placed on the tray to assist the adult in feeding the child and to train the child to feed itself. Frequently, these trays are hinged, pivoted or mounted on horizontally sliding supports to move the tray away from the child and make it easier to remove the child from the high chair.

For additional safety it also is common to attach a strap to the chair structure in order to keep the child from climbing, falling or sliding out of the chair.

These conventional high chairs, however, still leave a great deal to be desired.

For example, a typical high chair occupies additional floorspace in the dining area, thereby tending to crowd the dining area with a piece of furniture that has no other use than to accommodate an infant at meal times. Consequently, when not in use at meal times, a high chair is an obstacle to routine cleaning activity and other ordinary movement through the dining area.

The straps that are attached to the usual high chair, moreover, permit the infant to sway from side-to-side. This can be dangerous because the child's swaying might cause the high chair, with its high center of gravity, to tip over and, possibly, injure the infant.

There is a further and equally serious inadequacy, albeit quite subtle, in prior art high chairs. Thus, the shapes of these chairs make no concession to the shape of the occupying child's body. Those designs, moreover, that do provide the chair portion with seat and back cushions are dominated in shape and location either by esthetics or by manufacturing convenience, with no thought to the comfort and physical well-being of the occupying infant.

These prior art high chairs also are quite inflexible in that they do not permit adjustments to be made with respect to the position of the chair portion relative to the balance of the high chair structure. The trays on these high chairs, as mentioned above, are movable relative to the chair structure. To move these trays, either away from the chair in order to place a child in the chair, or into a horizontal position preparatory to feeding the child require the adult to use both hands to manipulate the tray in an appropriate manner. This can be very awkward and inconvenient, especially if the adult is, as it often happens, holding the child, or the child's food, at the same time.

DESCRIPTION OF THE INVENTION

These and other disadvantages that have characterized the prior art are overcome, to a large extent, through the practice of the invention.

Illustratively, a shoulder harness is provided that reduces an infant's sidewise movement in that a strap is drawn snugly over both of the child's shoulders. The strap is releasably joined at a buckle in the general area of the child's abdomen. The buckle, in turn, is attached by means of a short, sturdy link that is secured to the seat of the high chair. To improve the physical appearance of the high chair, plugs that match the color of the chair also are provided. These plugs fill in the sequence of holes that are formed in the back of the high chair to permit an incremental vertical movement of the strap in order to accommodate the growth of the child.

An additional feature of the invention enables the chair to tilt relative to its transverse axis to about three reclining angles. This tilting feature, it has been found, permits very young children to be fed more easily, at least until they develop the ability to feed themselves. Further in this connection, the high chair (as used to feed infants) is characterized by a tray that permits an adult, using only one-hand, to move the tray away from the high chair's seat, or to releasably lock the tray into a horizontal position above the infant's lap.

Illustratively the bottom surface of the tray has a broad "T" shaped recess that accommodates on the side of the tray that is opposite to the seat's backrest, a hand grip. The hand grip, in turn, is connected by two cables that extend through the recess almost to the opposite side of the tray that is closest to the seat, to each of a respective pair of levers on spring biased bell cranks. The bell crank levers that are not connected to the individual cables are each provided with a stop. Under force of the associated spring, each of these stops is pressed into a respective hole formed in the inner sides of the high chair arm rest to lock the tray in position on the high chair. By pressing the hand grip away from the side of the tray in which it is mounted, the bell cranks are pivoted against the respective springs to enable the stops to be withdrawn from their respective arm rest holes. In this way, the adult need only to continue the manual pressure on the hand grip to draw the tray away from the high chair in an horizontal plane. The tray is assembled on the high chair in almost the same manner. Thus the hand grip is drawn against the biasing spring force. The tray, however, is placed over the arm rests in an horizontal plane until the stops register with a particular set of arm rest holes, determined by the desired clearance between the infant and the adjoining edge of the tray. When properly registered, the hand grip is released and the bell crank biasing springs press the respective stops into the associated arm rest holes to lock the tray in the desired position, using only one of the adult's hands to accomplish these functions.

A foot rest is provided on the high chair, at the level of the average high-chair using child's feet, when the child is seated. In accordance with a feature of the invention, the foot rest is attached to the front legs of the high chair by means of two ears that each protrude from opposite sides of the footrest in alignment with the vertical axes of the high chair legs.

In keeping with this feature of the invention, the ears each have centrally disposed apertures to receive respective pins that protrude longitudinally upward from lower, detachable chair leg extensions. These pins, moreover, are in general alignment with the vertical axis of each of the respective chair leg extensions. A hole, formed in each of the portions of the chair legs that are attached permanently to the respective arm rests, receive the ends of the associated pins, thus temporarily locking the foot rest between the front legs by clamping the foot rest ears between the chair leg extensions and the chair legs.

Through the foregoing technique, the high chair adopts a modular configuration that permits the chair leg extensions to be removed, the extensions, when so removed, convert the high chair into a child's chair. The tray can be used with the chair in its high chair and child's chair modes, thereby overcoming the single-use, floorspace occupying disadvantage of high chairs that have characterized the prior art. As a further benefit from this modular development, a pair of arcuate rungs also can be provided, each with pins protruding from the ends of the rungs. These pins, received in the holes in the permanently attached legs, convert the child's chair into a child's rocking chair.

Additionally, the tray also can be provided with pin-receiving apertures, one in each of the four corners of the bottom surface of the tray. The four chair leg extensions can be connected to the tray by inserting each of the protruding leg extension pins into a respective tray recess. In this manner, a child's table and chair set can be assembled from the high chair through a very efficient use of high chair components.

Attention also is invited to a salient feature of the invention in which the chair's backrest that supports the child's back is provided with a lumbar support. The well-being and comfort of the child occupying the high chair seems never to have been taken into account in the prior art. Complaints from the child occupying a high chair are non-specific and, ordinarily, are ascribed by an attending adult to causes other than possible dissatisfaction with the seat. Consequently, this feature of the invention recognizes that which was overlooked in the prior art, that is, the need for a high chair that is not only comfortable, but that also provides a physiologically healthy support for a child with a growing and relatively pliable bone structure. Toward this end, a detailed analysis of the physical dimensions of male and female infants in the age range from birth through the second year of life indicates that a two to four inch wide lumbar support in the form of an convex, arcuately curved strip that is horizontally disposed on the back of the chair, the lower limb of which is spaced about four inches above the seat portion of the chair, is quite adequate for both infant comfort and for lumbar support purposes.

As a result, the invention provides a significant improvement in furniture design for children. Thus, the practice of the invention provides a safer, more flexible, more comfortable and healthier item of childrens' furniture than that which has characterized the prior art. The invention, moreover, is capable of several variants and equivalents, the scope of the invention being limited only through the claims appended hereto.

BEST MODE FOR CARRYING OUT THE INVENTION

Figure 1:
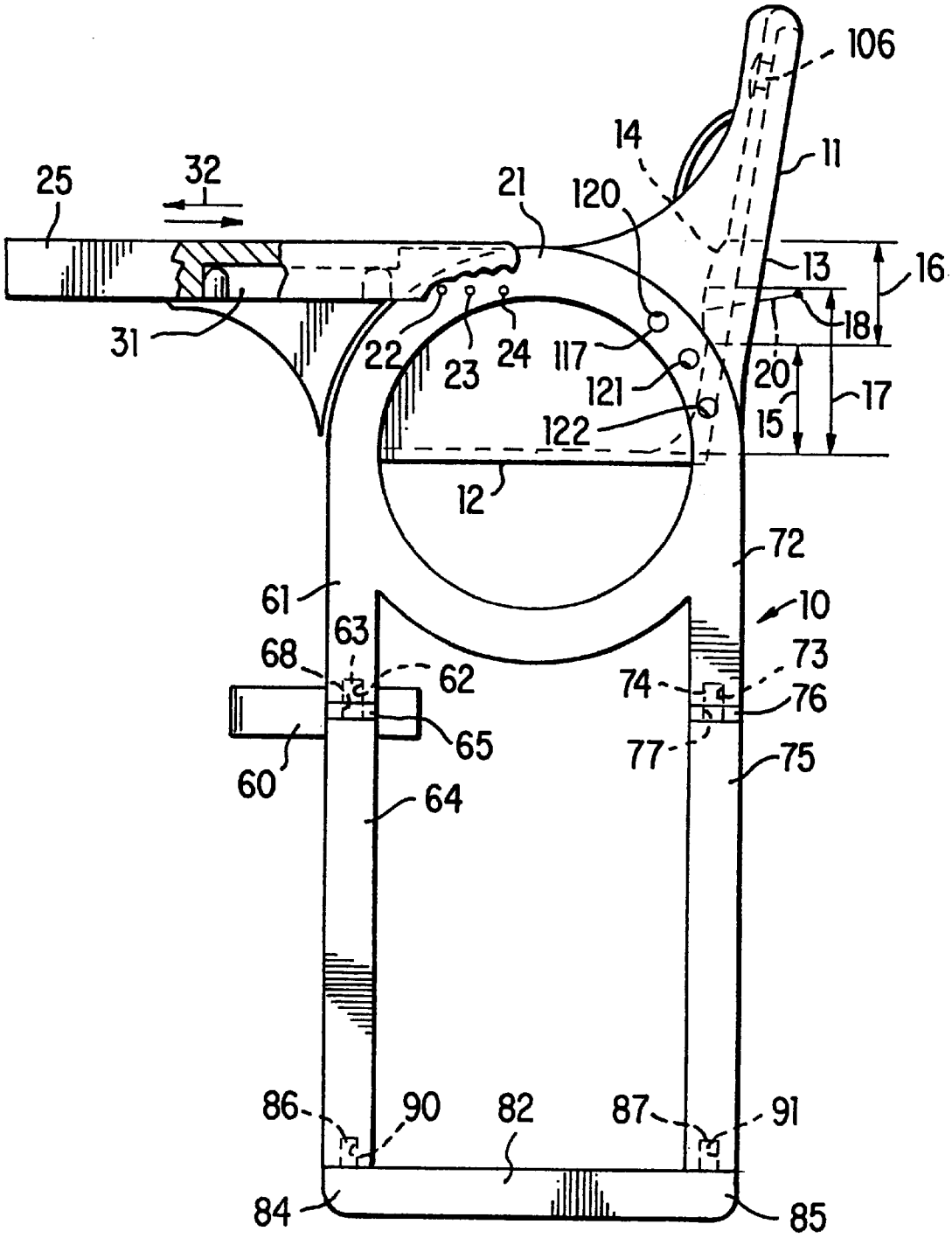
FIG. 1 is a side elevation of the invention, assembled to provide a high chair, with the lumbar support shown in phantom lines.

For a more complete appreciation of the invention, attention is invited to FIG. 1 which shows a high chair 10 that has a chair 11. The chair 11 has a generally horizontally disposed seat 12 and a backrest 13 that is inclined relative to the seat by about 15° from a perpendicular with respect to the seat.

In accordance with an important characteristic of the invention, a convex lumbar support 14 protrudes from the surface of the backrest 13 in the direction of the seat 12. The center of the lumbar support 14, preferably, is spaced about 4.62" perpendicularly from the bottom of the seat 12. The arc that forms the lumbar support 14, moreover, is developed from a circle that has a radius of six inches, the portion of the lumbar support that is closest to the seat 12 being spaced perpendicularly from the bottom of the seat by about 3.85". The complete arc that forms the lumbar support 14, moreover, forms a strip or band, best shown in FIG. 3 that is about four inches wide.

To develop these dimensions in order to provide a generally comfortable and orthopedically correct chair 11 for an infant during its first two years of life, a careful mathematical analysis was undertaken in the following manner.

Average Sitting Height from Seat

Adult Female: 32.9"

Adult Male: 38.5"

Average adult sitting height: 35.7"

Baby 0–2 months: 15.1"

6 months: 17.8"

12 months: 19.3"

18 months: 19.4"

24 months: 20.3

Adult Lumbar Support Height (measured from seat to bottom of lumbar support)=7.5"

Therefore:

$$\frac{\text{Adult Seated Height}}{\text{Adult Lumbar Support Height}} = \frac{\text{Baby Seated Height}}{\text{Baby Lumbar Support Height}}$$

$$\frac{35.7''}{7.5''} = \frac{15.1''}{x} \quad \text{(for 0 to 2 months)}$$

$$x = 3.17''$$

calculated for each of the above five infant growth periods:

0–2 months=3.17

6 months=3.73

12 months=4.05

18 months=4.07

24 months=4.26

Average baby lumbar support distance=3.85"

To calculate the preferred width of the lumbar support strip, given that a suitable average adult lumbar support width is 4":

$$\frac{\text{Adult Seated Height}}{\text{Adult Lumbar Support Height}} = \frac{\text{Baby Seated Height}}{\text{Baby Lumbar Support Height}}$$

$$\frac{35.7''}{4''} = \frac{15.1''}{x} \quad \text{(for 0 to 2 months)}$$
$$x = 1.69''$$

calculated for each of the above five infant growth periods:

0–2 months=1.69"
6 months 1.99"
12 months=2.16"
18 months=2.17"
24 months=2.27"

Average baby lumbar support width=2.05"

The radius for an infant's lumbar support is calculated in the following manner:

$$\frac{\text{Average Adult Sitting Height}}{\text{Center of Lumbar Support}} = \frac{\text{Baby Sitting Height}}{x}$$

Where, from established data the lumbar support center is about 9", $$\frac{35.7''}{9''} = \frac{15.1''}{x}$$
$$x = 3.8''$$

calculated for each of the above five infant growth periods:

0–2 months=3.8"
6 months=4.5"
12 months=4.8"
18months=4.9"
24months=5.1"

Thus, the average lumbar support center should be spaced 4.62" from the seat 12

Finally, the average infant lumbar support radius also should be calculated.

Consequently, the dimension for the infant's lumbar support 14 (FIG. 1) averaged over the first twenty four months of a child's life (the time during which a high chair is most useful) are:

Height of lumbar support from seat=3.85"

Width of lumbar support=2.05"

Center of lumbar support from seat=4.62"

Lumbar support radius=2.53"

These dimensions are further illustrated in FIG. 1 in which height 15 of lumbar support from the seat 12 is approximately 3.85". Lumbar support width 16 is about 2.05". As measured from the seat 12, a center 17 of the lumbar support 14 is generally in a range between 4.62" and 4.88", while lumbar support measured from center 18, enjoys a radius 20 that is on the order of 2.53".

The high chair 11 has a pair of arm rests, only the arm rest 21 being shown in FIG. 1 of the drawing. As shown the arm rest 21 is a vertically oriented annulus that has a set of three, horizontally aligned and equally spaced holes 22, 23, 24 formed in the arm rest.

Figure 2:
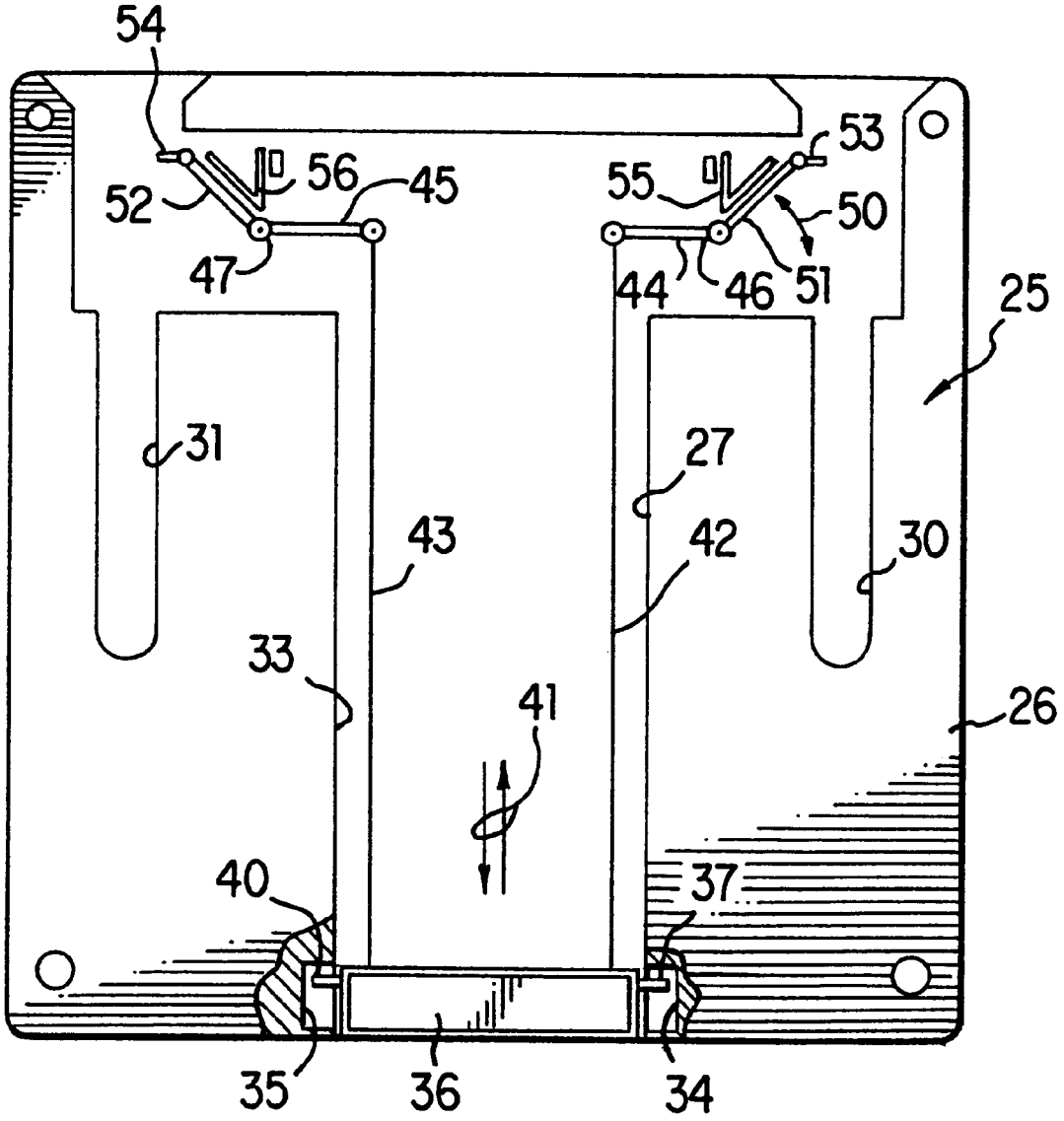
FIG. 2 is a bottom plan view of a tray for use with the high chair shown in FIG. 1.

A horizontally disposed tray 25 is mounted on the arm rests, as illustrated in FIG. 1. As best shown in FIG. 2, the tray 25 has, in its lower, horizontal surface 26 a generally "T" shaped recess 27. As shown, the recess 27 has a pair of parallel grooves 30, 31 that are laterally spaced from each other through a distance that is about equal to the center-to-center separation of the arm rests (FIG. 1). The grooves 30, 31, moreover, are sufficiently wide to fit over the arm rests, as shown in FIG. 1, without sticking or requiring an excessive use of force to slide the tray toward and away from the backrest 13 of the chair 11, in the direction of arrows 32.

The tray 25 (FIG. 2) also has a broad, centrally disposed slot 33 that extends through the length of the tray, the slot 33 forming, in general, the shank of the "T" for the recess 27. A pair of opposed indentations 34, 35, are formed in the opposite walls of the slot 33 on the end of the tray 25 that protrudes beyond the high chair 11 (FIG. 1). A hand grip 36 has a pair of laterally protruding pins 37, 40 that are received in the respective indentations 34, 35 in order to enable the handgrip 36 to move in a horizontal plane through a distance determined by the length of the indentations 34, 35, the motions of the hand grip 36 being limited to the direction of arrows 41.

A pair of cables 42, 43, are joined to respective laterally opposite ends of the hand grip 36 and are each stretched through the slot 33 where, at the end opposite to the hand grip, each of the cables 42, 43 is attached to individual ends of lever arms 44, 45 on a pair of bell cranks 46, 47. The bell cranks 46, 47 are pivoted to the recessed lower horizontal surface 26 of the tray 25 in order to rotate in the horizontal plane in the direction of arrow 50. As shown, the bell cranks 46, 47 control the movement of outwardly oriented levers 51, 52 that terminate, respectively, in stops 53, 54. The stops 53, 54 are peg-shaped and have diameters and depths that enable them to be inserted into or withdrawn from any one of the three holes 22, 23, and 24 (FIG. 1) in the adjacent arm rest 21.

Both of the outwardly oriented levers 51, 52 are biased by means of associated "V" shaped leaf springs 55, 56 to protrude toward respective perimeters of the tray 25.

Figure 3:
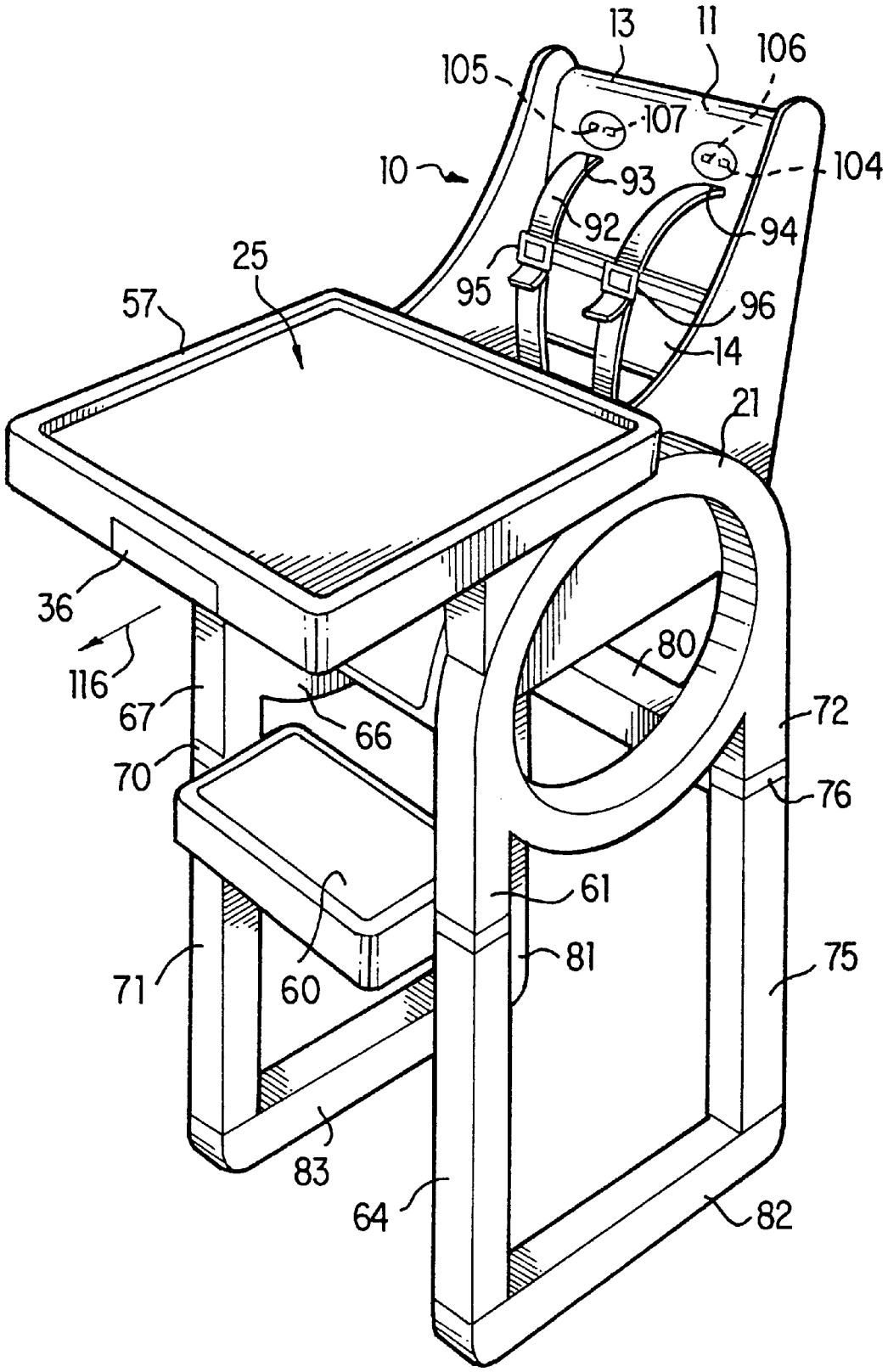
FIG. 3 is a perspective view of the high chair shown in FIG. 1 in which the restraining straps and lumbar support are more clearly illustrated.

As best shown in FIG. 3, moreover, the tray 25 has a frame 57 that forms the tray's perimeter. The frame 57 keeps dinnerware, utensils, spilled food, and the like on the tray 25 and prevents them from falling or, perhaps, being swept onto the floor by the infant in the high chair 10.

In accordance with another feature of this invention, attention now is invited to horizontally disposed footrest 60. As shown, the annular arm rest 21 has a vertically oriented chair leg 61 that is tangent to the outer circumference of the arm rest 21. As, perhaps, more clearly illustrated in FIG. 1, the chair leg 61 has a centrally formed hole 62 in the lower end in order to receive a pin 63 that protrudes upwardly, in a vertical direction from the center of vertical chair leg extension 64.

A footrest ear 65, which is attached to and protrudes in a horizontal plane from the side of the footrest 60 that adjoins the chair leg 61 and the leg extension 64, is sandwiched between the upper horizontal surface of the leg extension and the lower horizontal surface of the chair leg. The ear 65 has a centrally disposed vertical hole 68 that enables the pin 63 to pass through the ear and seat in the hole 62, thereby attaching the leg extension 64 and the footrest 60 securely to the high chair 10. Preferably, set screws (not shown), screws with wing nuts and the like can be secured to the combination of the chair leg 61 and chair leg extension 64 to releasably lock the structure together.

Best shown in FIG. 3, the high chair 10 has a parallel construction on the other side of the chair 11 for an annular arm rest 66, chair leg 67, footrest ear 70 and chair leg extension 71.

A vertical rear chair leg 72, is tangent with and attached to the perimeter of the annular arm rest 21 on the side of the arm rest that is diametrically opposite to the place of tangent attachment for the front chair leg 61. FIG. 1 discloses, moreover, a vertical hole 73 formed in the lower horizontal surface of the rear chair leg 72. The hole 73 receives a vertical and centrally disposed pin 74 that protrudes upwardly from rear chair leg extension 75 in order to sandwich a rear leg brace ear 76 between the rear chair leg 71 and the chair leg extension. The ear 76 has a centrally positioned vertical hole 77 that enables the pin 74 to pass through the hole in the ear in order to seat the pin within the hole 73 in the rear chair leg 72. To stabilize the high chair 10 and to prevent tilting or rocking, the thickness of the leg brace ear 76 is generally equal to that of the footrest ear 65.

Turning now to FIG. 3, rear leg brace 80 is shown framed in the central opening formed by the arm rest 21. The leg brace 80 engages a rear chair leg extension 81 by means of an ear (not shown) with another, vertically arranged rear chair leg (also not shown) in the manner described above with respect to the rear chair leg 72 and the rear chair leg extension 75.

The lower ends of the front chair leg extensions 64, 71 and their associated rear chair leg extensions 75, 81 are joined by a pair of parallel bottom rungs 82, 83, respectively, in order to provide a sturdy, well-constructed item of furniture. As shown in FIG. 1, the rung 82 (as well as the companion rung 83, not shown in FIG. 1) has rounded transverse ends 84, 85 to remove potentially hazardous sharp edges. The upper surface of the rung 82 also has a pair of vertical pins 86, 87 that protrude upwardly from the transverse ends of the rung in order to be received in individual mating holes 90, 91 formed in alignment with the respective pins in the lower surfaces of the front chair leg extension 64 and the rear chair leg extension 75. As previously mentioned with respect to the pins 63 and 74, set screws, wing nuts and the like all can be used to releasably lock the rung 84 and the associated pins 86, 87 to the leg extensions 64, 75.

Figure 5:
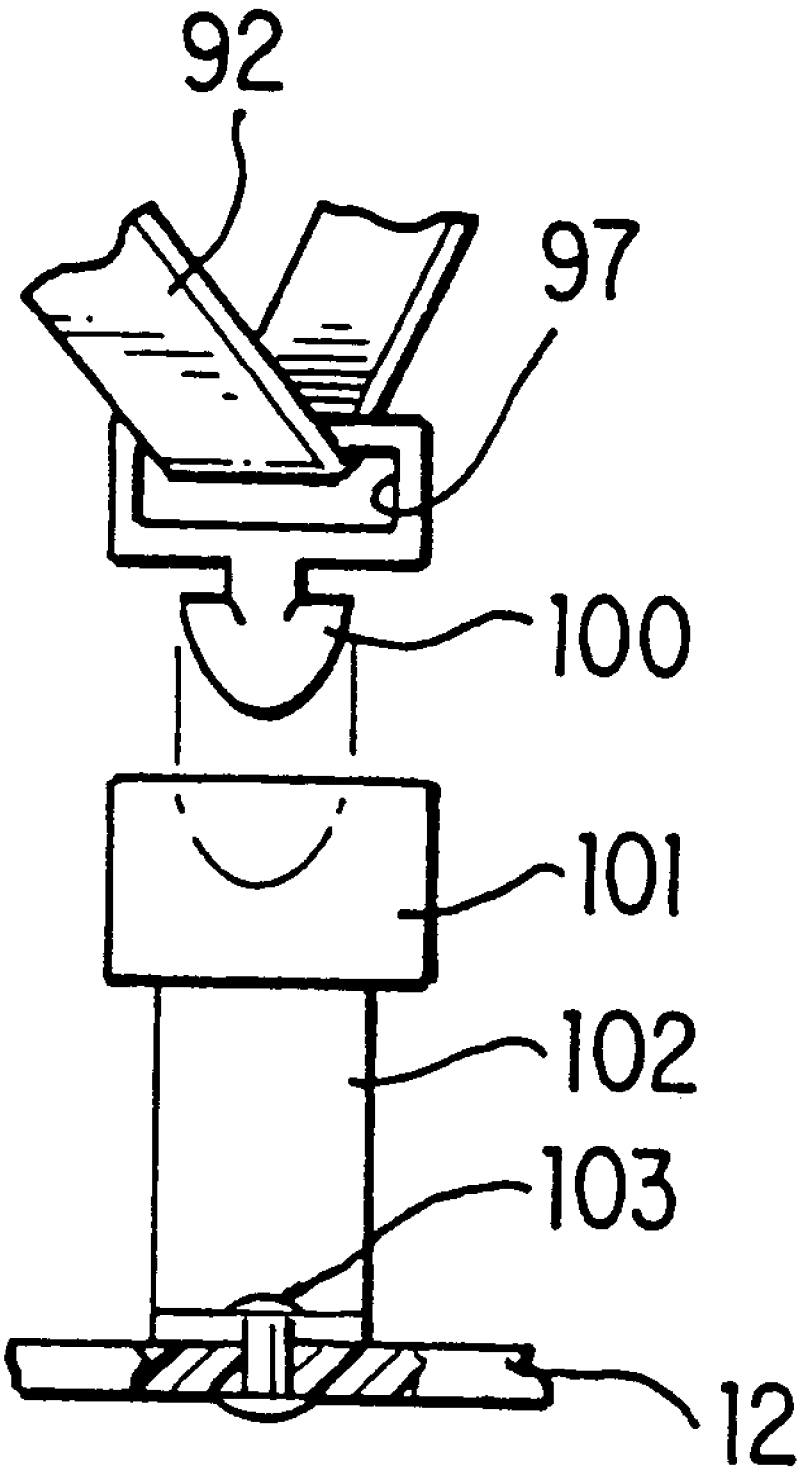
FIG. 5. is a detail view of the restraining strap connection for the high chair shown in FIGS. 1 and 3.

Attention again is invited to FIG. 3 and the chair 11 which has safety strap 92 that passes through apertures 93, 94 formed in the backrest 13 above the lumbar support 14. The strap 92 has buckles 95, 96 that establish easy adjustments of the length of the strap 92 to match the dimension of the child occupying the chair 11 and to restrain the child from indulging in a potentially dangerous, side-to-side, swaying motion. Note in FIG. 5 that the strap 92 passes through a loop 97 in a tongue 100. To secure the child in the chair 11, the tongue is releasably inserted into a latch 101 that is joined by a link 102 and a rivet 103 to seat 12 of the chair.

To accommodate for the rapid growth of infants in the range from birth to two years of age, an additional pair of apertures 104, 105 are formed in the backrest 13 at equally spaced distances above the individually associated apertures 93, 94. These apertures 104, 105 permit the strap to be raised as the child who uses the chair 10 grows in height. To provide a more finished appearance for the high chair 10, as well as to prevent an unsightly and unhealthy accumulation of dirt, food and the like in these apertures 104, 105, flexible plastic plugs 106, 107 that have a generally mushroom shape are pressed, shank first, into the associated apertures as best shown in FIG. 1.

Figure 4:
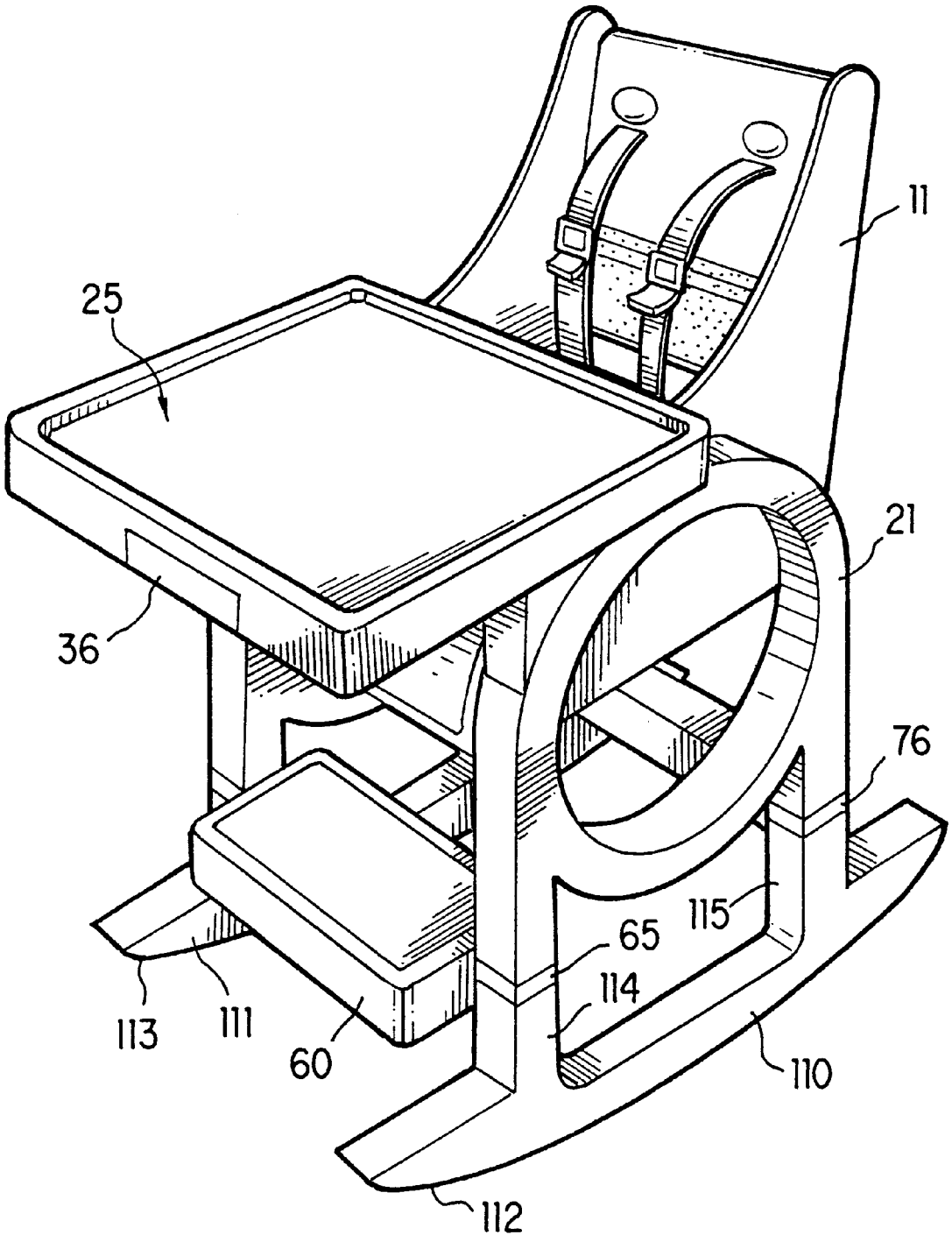
FIG. 4. is a partially exploded side elevation of the chair shown in FIGS. 1 and 3, assembled to provide a child's rocking chair.

It will be recalled that modular use of the high chair 10 is an important feature of the invention. For example, FIG. 4 shows the chair 11, described above in connection with FIGS. 1 through 3, in a modular adaption to a child's rocking chair. As shown in FIG. 4 rungs 110, 111 have arcuate lower surfaces 112, 113 that ordinarily characterize the rungs of a rocking chair.

Members 114, 115 that protrude upwardly from the rungs 110, 111 engage the abutting ends of the front chair leg 61 and the rear chair leg 72 with which they are each aligned. Further in this connection, the footrest ear 65 and the leg brace ear 76 are sandwiched between their associated front and rear chair legs 65, 76 and the lower engaging members 114, 115 through a pin mechanism (not shown in FIG. 4) of the type described with respect to the front and rear chair leg extension 64, 75 (FIG. 1).

Clearly, the modular furniture described herein is subject to considerable modification. For instance, the flat rungs 82, 83 (FIG. 3) can be substituted for the arcuate rungs 110, 111 (FIG. 4) to convert the high chair into a comfortable child's non-rocking chair. As the child grows in height, the footrest 60 can be removed to permit the child's feet to rest directly on the floor. Further, the tray 25 can be used with or removed from the chair in any of the possible chair configurations.

Thus, the disassembled high chair can be reassembled as a child's table and chair combination. The tray 25 is removed from its position on the arm rests 21, 66 and the pins on the chair leg extension 64, 71, 75 and 81 (of which only the pins 63 and 74 are shown in FIG. 1) are inserted into respective holes (not shown in the drawing) in the lower horizontal surface 26 of the tray 25 in order to provide a table with four legs, and a separate infant's chair.

In operation, the hand grip 36 (FIG. 3) is drawn horizontally away from the tray 25 in the direction of arrow 116. As best shown in FIG. 2, the hand grip 36, so moved, pivots the bell crank 46 in a counter-clockwise direction and pivots the bell crank 47 in a clockwise direction. These pivoting movements withdraw the stops 53, 54 from their respective holes in the arm rests 21, 66, of which only the holes 22, 23, 24 in the arm rest 21 are shown in FIG. 1 of the drawing. The tray 25 then can slide off the arm rests 21, 66, that are received in the respective parallel grooves 31, 30 (FIG. 2) through manipulation of only one adult hand.

The child is placed in the chair 11 and the safety strap 92 is placed over each of the child's shoulders. The tongue 100 (FIG. 5) is snapped into the latch 101 to secure the child in the chair 11. Next, the lengths of the strap are adjusted by drawing the strap ends through the buckles 95, 96 until a snug, but not uncomfortable fit is established for the child.

The tray 25 is reconnected to the arm rests 21, 66 by drawing the hand grip 36 again in the direction of the arrow 116 (FIG. 3) against the forces of the leaf springs 55, 56. The grooves 31, 30 are placed over their respective arm rests 21, 66 and the tray 25 (FIG. 1) is moved toward the backrest 13 until the desired clearance between the infant and the tray is reached. The hand grip 36 then is released to permit the stops 54, 53 (FIG. 2) to pivot into the nearest set of holes, of which the holes 22, 23, and 24 shown in FIG. 1 (that are associated with the stop 54) are typical.

To tilt the chair 11 to a desired inclination from the horizontal to make infant feeding more comfortable, a plug 117 is inserted in any desired one of the tilt regulating holes 120, 121, 122 found in the arm rest 21 to engage a corresponding hole (not shown in the drawing) to permit the chair 11 to tilt back about a pivot (also not shown in the drawing) that joins the chair 11 to the arm rest 21, generally at the place of tangency between the arm rest 21 and the front chair leg 61. Typical mechanisms for enabling the chair 11 to tilt that are suitable for use with the present invention are shown in the prior art.

To remove the infant from the high chair 10, it is only necessary to once more remove the tray 25 from the arm rests 21, 66 in the manner described above, and to unbuckle the safety strap 92 by releasing the latch 101.

To change the high chair 10 into the child's rocking chair shown in FIG. 4, the set screws (if provided) are released and the front and rear chair leg extension 64, 71, 75, 81 are pulled from their mating positions with the associated front and rear chair legs 61, 67, 72. The rocker rungs 110 and 111 are then attached to the front and rear chair legs, the set screws tightened and thus, in accordance with a feature of the invention, the high chair, that otherwise would inconveniently occupy an inordinate amount of dining room floorspace, is converted into an item of children's furniture for use during those times of day when a high chair is not needed.

Figure 6:
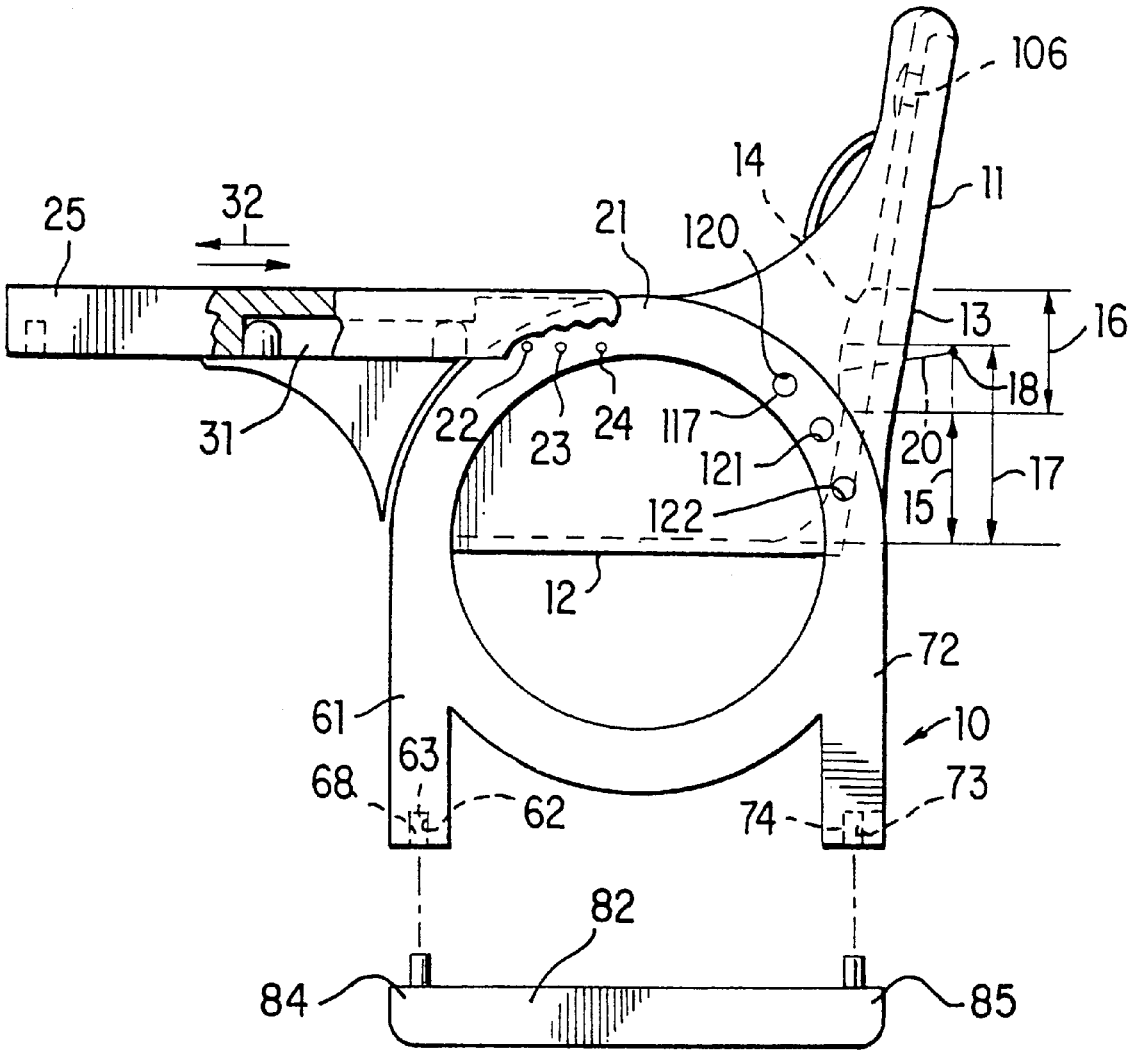
FIG. 6 is a partially exploded elevation of the invention of a table, assembled from the modular furniture components that characterize the invention is a non-rocking chair, shown in a perspective view, also assembled from modular furniture components in accordance with the principles of the invention.

To convert the high chair into a non-rocking chair as shown in FIG. 6, the flat rungs 82, 83 shown in FIG. 1 can be substituted for the rocker rungs 110, 111. To assemble a child's table, the chair leg extensions 64, 71, 75 and 81 (not shown in FIG. 6) then, if desired, can be inserted, pin first, into corresponding holes each formed in a respective corner of the lower horizontal surface 26 of the table 25 (FIG. 2). In this manner a child's chair and table combination can be provided through an efficient utilization of the leg extensions. To provide an appropriate height of the table relative to the child's chair, moreover, it has been found that the table leg extensions each should be twice as long as the associated chair legs (of which only the legs 61, 67 and 72 are shown in FIG. 2 of the drawing) to which they are attached when the structure that characterizes the invention is assembled in a high chair configuration. Thus, when connected as a high chair, the leg extension each are two thirds of the overall length of the leg assemblies. Of course, to restore the chair to a high chair configuration, it is only necessary to reverse the procedure described above, and replace the front and rear chair leg extensions 64, 71, 75, 81.

I claim:

1. Orthopedically correct modular furniture for a child with a growing and pliable bone structure comprising a pair of laterally spaced arm rests having a first plurality of tray adjustment holes formed therein and having a second plurality of tilt control holes formed therein, a first pair of chair legs each coupled to a respective one of said arm rests and spaced from said tray adjustment holes, a second pair of chair legs, each coupled to a respective one of said arm rests on a side of said armrests that is generally opposite to the places of coupling for said first pair of chair legs, said second pair of chair legs joining said arm rests in the vicinity of said tilt control holes, a chair interposed between said laterally spaced arm rests, said chair being pivotally jointed to said arm rests near the places of coupling for said front chair legs, said chair having at least one pair of holes formed in opposite lateral sides thereof for selection alignment with said tilt control holes, a backrest for said chair between the lateral sides thereof, a seat for said chair between said lateral sides thereof, and a lumbar support on said backrest having an outer convex surface spaced pependicularly from said seat by a distance that is predetermined by the average size of the child for which the modular furniture is intended to produce an orthopedically correct and physiologically healthy support for the growing and pliable bone structure of the child, said furniture further comprising a tray having a bottom surface with a "T" shaped recess formed therein, a hand grip mounted at the shank of said "T" shaped recess for movement parallel to said shank, at least one spring biased bell crank having two lever arms, said bell crank being mounted in the cross of said "T" shaped recess for rotation in a plane parallel to said bottom surface, a stop formed on one of said bell crank levers for selective engagement with at least one of said tray adjustment holes, and means for connecting said hand grip with the other of said bell crank lever arms in order to rotate said bell crank against said spring bias.

2. An orthopedically correct high chair for a child with a growing and pliable bone structure, comprising legs, an elevated seat mounted on said legs, a substantially planar backrest extending at an angle to said seat and a convex lumbar support protruding from a front surface of said backrest in the direction of said seat, said lumbar support being stationary relative to said backrest, and having a region of maximum protrusion spaced perpendicularly from said seat between 3.8" and 5.1", wherein the bottom extremity of said lumbar support is spaced from said seat between 3.17" and 4.26", wherein said lumbar support has a width between 1.69" and 2.27";

said high chair further comprising a pair of armrests and a feeding tray removably mounted on said armrests, said tray having a front end, a rear end and a bottom surface with a "T"-shaped recess formed therein, said recess including a longitudinal slot which forms a shank of said recess, said shank terminating in a transverse cross region extending substantially parallel to said rear end, a selectively activatable handgrip movably secured to said bottom surface of said tray adjacent said front end of said tray, said handgrip being movable parallel to said shank towards and away from said backrest, and means within the cross region connected to said handgrip for releasably locking said tray at a fixed position relative to said backrest, whereby said tray can be released and removed by pulling on said handgrip.

3. A high chair as defined in claim 2, further comprising means operatively connected to said handgrip for resiliently biasing said handgrip towards said backrest so that said tray is in a fixed position.

4. A high chair as defined in claim 3, further comprising a bell crank pivotally mounted in said cross region of said "T" shaped recess for rotation in a plane parallel to said bottom surface, said bell crank having a first lever arm connected to said handgrip through said recess and a second lever arm with stop means for releasably engaging an armrest to prevent movement of said tray relative to said backrest, and a spring biasing said bell crank in a locked direction with a force that can be overcome by pulling said handgrip with one hand.

5. An article of furniture having a seat, a backrest, a pair of armrests and a tray having a front end and a rear end, said tray slidably and removably mounted on said armrests to position said rear end towards said backrest, said tray comprising a bottom surface with a "T" shaped recess formed in said bottom surface, said recess including and defining a shank region extending perpendicularly to said rear end and a cross region extending substantially parallel to said rear end, a selectively activatable handgrip movably secured to said bottom surface adjacent an end of said shank adjacent said front end, locking means positioned in said cross region of said recess and connected to said hand grip for releasably locking said tray at a fixed position relative to said backrest, said handgrip being movable in a direction away from said backrest by application of manual force to release said locking means for removal of said tray.

6. An article as defined in claim 5, further comprising biasing means mounted in said cross region of said recess for resiliently urging said locking means towards a locked position while simultaneously resiliently urging said handgrip towards said backrest.

7. An article of furniture as defined in claim 5, wherein said means for releasably locking said tray comprises, a pair of bell cranks pivotally mounted in said cross region for horizontal rotation, each of said bell cranks having a lever arm with a stop mechanism adapted to engage a respective one of said armrests when pivoted in a first direction to releasably lock said tray in a fixed position relative to said backrest, said handgrip being connected to said bell cranks through said recess so that pulling of said handgrip causes said lever arms of said bell cranks to pivot away from said armrests for removal of said tray, and a pair of springs mounted in said cross region of said recess and respectively cooperating with a corresponding bell crank thereby resiliently biasing said lever arm towards a locked position and said handgrip towards an innermost position.

8. An article as defined in claim 7, wherein said bell cranks each have a second lever arm and said handgrip is connected to said second lever arms by a pair of cables in said recess extending along said shank, whereby movement of said handgrip away from said backrests exerts forces on said second lever arms through said cables to rotate said bell cranks so that said first lever arms pivot away from said armrests.

9. article as defined in claim 8, wherein said armrests each have a hole formed therein and said tray includes stop mechanisms in said cross region which have an extension for engaging said hole when said first lever arms are pivoted by said springs towards said armrests.

10. An article as defined in claim 9, wherein said armrests each have a plurality of holes adapted to engage said extensions for selectively positioning said tray relative to said backrest.

* * * * *